US012716417B2

(12) United States Patent
Pyron et al.

(10) Patent No.: US 12,716,417 B2
(45) Date of Patent: Aug. 25, 2026

(54) SPLIT THRUST CHAMBER FOR DOWNHOLE PUMP

(71) Applicant: Halliburton Energy Services, Inc., Houston, TX (US)

(72) Inventors: Steven Pyron, Tulsa, OK (US); Jeffrey Frey, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/973,566

(22) Filed: Dec. 9, 2024

(65) Prior Publication Data

US 2026/0160256 A1 Jun. 11, 2026

(51) Int. Cl.
*F04D 13/10* (2006.01)
*F04D 29/041* (2006.01)

(52) U.S. Cl.
CPC ..... *F04D 13/10* (2013.01); *F04D 29/0413* (2013.01)

(58) Field of Classification Search
CPC ..... F04D 13/10; F04D 29/0413
See application file for complete search history.

(56) References Cited

U.S. PATENT DOCUMENTS 10,082,150 B2 * 9/2018 Rutter ..... F04D 29/086
10,822,933 B2 * 11/2020 Crane ..... F04D 29/586
11,788,540 B2 * 10/2023 Watson ..... F04D 29/0413 417/423.3
2002/0153789 A1 * 10/2002 Knox ..... H02K 7/14 310/90
2002/0192090 A1 * 12/2002 Du ..... F04D 13/062 417/423.11
2005/0109515 A1 * 5/2005 Watson ..... E21B 43/128 166/65.1
2014/0219825 A1 * 8/2014 Santos ..... F04B 47/06 277/331
2015/0354582 A1 * 12/2015 Tanner ..... F04D 13/06 418/220
2019/0264735 A1 * 8/2019 Crane ..... F16C 17/04

FOREIGN PATENT DOCUMENTS

CN 106382246 A 2/2017
WO 2015187231 A1 12/2015
WO 2019165164 A1 8/2019
WO 2024148033 A1 7/2024

OTHER PUBLICATIONS

PCT/US2025/011456, "International Search Report and Written Opinion", Aug. 27, 2025, 12 pages.

* cited by examiner

*Primary Examiner* — Brian Christopher Delrue
(74) *Attorney, Agent, or Firm* — Kilpatrick Townsend & Stockton LLP

(57) ABSTRACT

A system can be used in a wellbore. The system can include a first thrust chamber, a second thrust chamber, and a seal guide. The first thrust chamber can include a first bearing for absorbing thrust in a first direction in the wellbore. The second thrust chamber can include a second bearing for absorbing thrust in a second direction in the wellbore that is different than the first direction. The seal guide can be positioned between the first thrust chamber and the second thrust chamber to separate the first thrust chamber from the second thrust chamber. The seal guide can protect the second thrust chamber and can provide radial support for a shaft that can be positioned in the first thrust chamber and the second thrust chamber.

20 Claims, 4 Drawing Sheets

SPLIT THRUST CHAMBER FOR DOWNHOLE PUMP

TECHNICAL FIELD

The present disclosure relates generally to wellbore operations and, more particularly (although not necessarily exclusively), to a split thrust chamber for a pump that can be positioned in a wellbore.

BACKGROUND

Wellbore operations may include various equipment, components, methods, or techniques to perform various tasks, such as fluid control, with respect to a wellbore. In some examples, the wellbore operations may involve using a downhole pump such as an electric submersible pump to control fluid flow with respect to the wellbore. The downhole pump can be positioned downhole in the wellbore to perform a subset of the wellbore operations. In some examples, the downhole pump may experience thrust forces during operation. It can be difficult to prevent or mitigate damage to the downhole pump during operation downhole.

DETAILED DESCRIPTION

Figure 1:
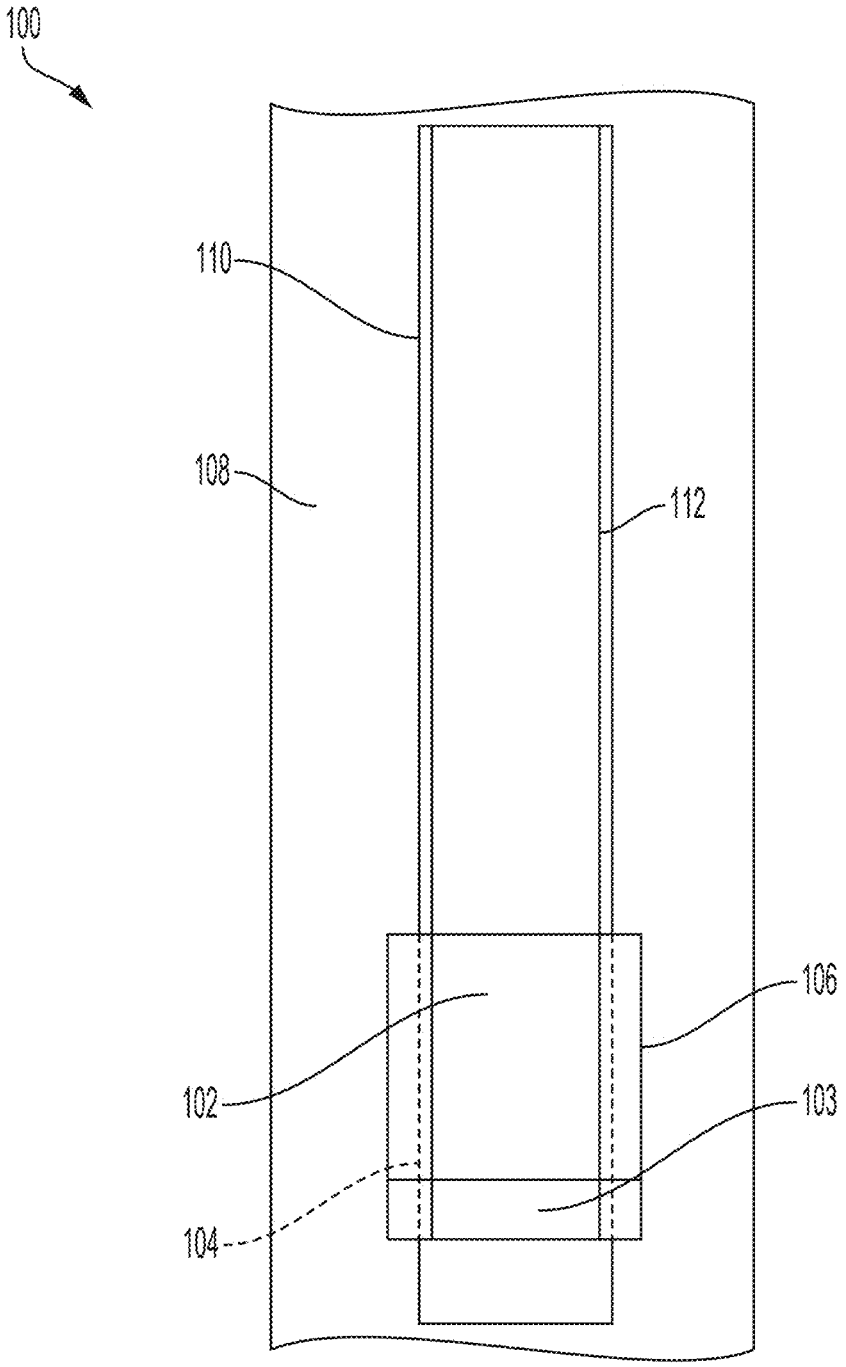
FIG. 1 is a diagram of a well system that can include a downhole pump that can include a split thrust chamber according to some aspects of the present disclosure.

Certain aspects and examples of the present disclosure relate to a split protected thrust chamber that may be used in electrical submersible pumps (ESP) for wellbore operations. The split protected thrust chamber may include multiple chambers, multiple thrust bearings, or a combination thereof. The multiple chambers, the multiple thrust bearings, or a combination thereof can be offset, such as in an axial direction, from one another, for example to increase heat dissipation and oil coverage in the split protected thrust chamber. The multiple thrust bearings can help protect the ESP, or any component thereof, from sudden forces, such as thrust forces, in a wellbore. The ESP can be used to control fluid flow in the wellbore.

In some examples, the split protected thrust chamber may be deployed or otherwise positioned in high-temperature settings like a steam-assisted gravity drainage (SAGD) well, a geothermal well, or other suitable high-temperature settings. The SAGD well may involve heavy oil recovery in which steam can be injected into the oil reservoir to heat the oil for reducing its viscosity and making the oil easier to extract. An ESP can be positioned in a wellbore to perform a wellbore operation such as with respect to the SAGD, the geothermal well, etc. The ESP can include the split protected thrust chamber, which can include multiple thrust bearings in multiple housings. Separating the thrust bearings can improve lubrication and cooling efficiency, prevent crosscontamination between the chambers, and improve the overall reliability and longevity of the ESP.

In some examples, the ESP can be used to lift fluids, such as oil or water, from wellbores to the surface or in other suitable directions. In other systems involving an ESP, upthrust bearings and downthrust bearings can be housed together in the same chamber, for example with limited oil volume to manage heat and lubrication effectively. The split protected thrust chamber may be divided into multiple separate and distinct chambers. In some examples, the multiple separate and distinct chambers can include two separate and distinct chambers, which can include (i) an upper chamber for the upthrust bearing and an associated runner and (ii) a lower chamber for the downthrust bearing and an associated runner. A seal guide that can include mechanical seal may be positioned between the two separate and distinct chambers, and the mechanical seal can block well fluid from reaching the downthrust chamber if fluid were to leak into the upthrust chamber. The mechanical seal may otherwise control fluid flow between the chambers to optimize oil flow, heat dissipation, or a combination thereof in the split protected thrust chamber. By isolating the downthrust bearing from contaminants, the split protected thrust chamber may help in preventing damage to the ESP motor and in maintaining system reliability. Additionally or alternatively, with each bearing in the system being positioned in its own chamber, there can be more volume for oil around the bearings, and the increased volume of oil may lead to better heat dissipation, compared with other systems, and improved lubrication compared to other systems.

Other thrust chambers in ESPs may be prone to failures, such as in high-temperature environments including steam-assisted gravity drainage (SAGD) applications in which oil viscosity can drop significantly. By reducing the oil viscosity, lubricity may be reduced, and bearing damage may be caused. The split protected thrust chamber, such as the split chamber included in an ESP, may remedy these conditions by maintaining separation between the bearings. The separation may assist in providing more consistent lubrication and thermal management in high-temperature environments. Separating the upthrust and downthrust bearings into distinct chambers may allow more oil to surround each bearing, enhancing heat dissipation and improving lubrication under extreme conditions. The presence of a protective mechanical seal, such as via a seal guide, between the two chambers can help shield the downthrust bearing and the motor from bronze debris, or other debris, if the upthrust bearing fails unexpectedly. The protective setup may increase the reliability of the downthrust bearing, which can result in longer operational run times and more consistent performance of the ESP system.

In some examples, a split protected thrust chamber system may include a shaft that extends through one or more, or each of the, chambers included in the system. An upper thrust chamber may house an upthrust bearing and an upthrust runner. The upthrust bearing can be installed within the upper thrust chamber housing in a manner in which the upthrust runner may be keyed to the shaft and configured to control the axial movement of the shaft. Below the upper thrust chamber, a seal guide may be positioned to separate the upper thrust chamber from other chambers in the system. The seal guide can include a shaft radial support bearing to stabilize the shaft, and the seal guide can include a mechanical seal to protect a lower thrust chamber. The mechanical seal may provide a barrier to shield a downthrust bearing from contaminants or debris. In some examples, the lower thrust chamber may house a second runner and a downthrust bearing. The second runner can also be keyed to the shaft and used to transmit thrust loads from the shaft to the downthrust bearing, which may sit atop a seal base. The downthrust bearing and the second runner arrangement may be used to manage forces in the opposite axial direction from the upthrust bearing and the first runner arrangement, for example for providing stability and load-bearing capacity for the system.

In some examples, the components of the system may be modified such as via modifications to the positions of the upthrust or downthrust bearings. The spacing between the upthrust bearing and the downthrust bearing can be adjusted to increase or decrease the oil volume surrounding each bearing for tuning the system for optimal heat dissipation and lubrication properties based on specific operational needs. The radial shaft supports housed in the seal guide can also vary, with designs ranging from standard supports to more specialized configurations for providing enhanced stability or customized load-bearing properties. The type of protective device between thrust chambers included in the system can differ such as in alternative designs. For example, the mechanical seal can be replaced or supplemented with lip seals, O-ring-based sealing devices, or even omitted in certain examples, depending on the desired level of protection and system requirements. The geometry and porting of the seal guide may also be adjusted to create a tortuous path between the chambers, which can serve to further restrict fluid and debris transfer. Variations in the thrust runner design can include changes in geometry or metallurgy to meet different performance criteria.

In some examples, different methods for securing the upthrust bearing may be used. The different methods may include using a thread pinch mechanism instead of a mechanical stop sleeve, etc. Additional components, such as pipes or tubing, can be incorporated to form labyrinthine chambers within either the upthrust or downthrust chamber for enhancing fluid management and protection. Protective devices can also be arranged in series or parallel, providing multiple layers of defense, such as additional mechanical seals. The overall seal configuration can be modified, with the upthrust and downthrust chambers separated by other intermediary chambers, such as bag chambers or labyrinth chambers, for further isolation and control. The positioning of the chambers can be reversed, with the downthrust chamber situated above the upthrust chamber. In some examples, the upthrust chamber can be integrated into an upper tandem seal, while the load-bearing downthrust chamber might be positioned in a lower tandem seal to allow for a more flexible and adaptable system design.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a diagram of a well system 100 that can include a downhole motor 102 and a thrust chamber 103 that can be positioned within a wellbore 108. The downhole motor 102 may be encapsulated within a motor housing and can be located in the wellbore 108. In some examples, the downhole motor 102 can be used to facilitate wellbore operations such as fluid pumping or other fluid control. The thrust chamber 103 may be coupled to or otherwise included in the downhole motor 102, and the thrust chamber 103 can provide force management, such as in an axial direction, for forces generated during operation. The thrust chamber 103 may include various components, such as up-thrust bearings and down-thrust bearings, that can be used to improve the performance and reliability of the downhole motor 102 in demanding wellbore environments.

The well system 100 may include a flow path 104 that can be defined through the thrust chamber 103 and other components. The flow path 104 can act as a conduit for directing fluids, such as well fluids or produced hydrocarbons, from the downhole motor 102 and through the internal components of the pump system. The design, such as the size or shape, of the flow path 104 may facilitate smooth and controlled fluid movement, which can help in maintaining consistent pressure and flow rates within the well system 100. In some examples, the flow path 104, or the size, shape, or arrangement thereof, may be optimized to reduce turbulence and pressure losses.

A flow tube 112 may also be included within the well system 100. The flow tube 112 can be positioned within the interior of the well system 100 and may assist in directing the flow of fluids more efficiently. For instance, the flow tube 112 may help guide fluids through the thrust chamber 103 or the downhole motor 102 and into subsequent sections of the well system 100 for reducing turbulence and minimizing pressure drops as the fluids are conveyed downstream.

In some examples, the thrust chamber 103 may include multiple chambers that may be offset from one another. The multiple chambers may include a first chamber and a second chamber that can be axially offset from the first chamber. The first chamber may be or include an upthrust chamber that includes an upthrust bearing, and the second chamber may be or include a downthrust chamber that includes a downthrust bearing. The first chamber and the second chamber may be positioned around a seal guide that can separate the first chamber from the second chamber. The seal guide can include a mechanical seal or other physical obstruction that can be used to control, such as restrict, fluid flow between the first chamber and the second chamber.

Figure 2:
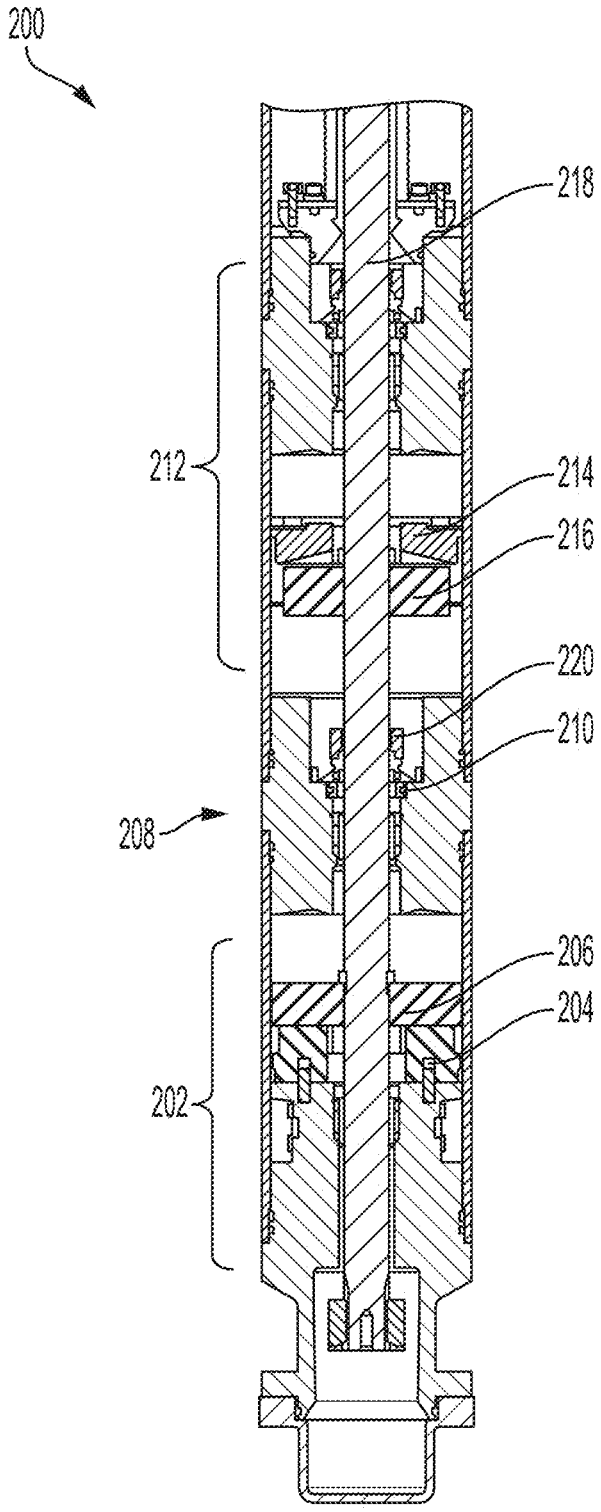
FIG. 2 is a cross-sectional view of a split protected thrust chamber according to some aspects of the present disclosure.

FIG. 2 is a sectional view of a split protected thrust chamber system 200 that may be used in an electrical submersible pump (ESP) according to some aspects of the present disclosure. The split protected thrust chamber system 200 may include a downthrust chamber 202, a downthrust bearing 204, a downthrust runner 206, a seal guide 208, a radial seal 210, an upthrust chamber 212, an upthrust bearing 214, an upthrust runner 216, a shaft 218, and a mechanical seal 220. In some examples, the split protected thrust chamber system 200 may include any additional, alternative, or fewer components for providing functionality to the ESP or to the split protected thrust chamber system 200. The shaft 218 may extend through each of the components of the split protected thrust chamber system 200 or any subset thereof.

The downthrust chamber 202 may house the downthrust bearing 204 and the downthrust runner 206. For example, the downthrust bearing 204 and the downthrust runner 206 may be positioned at least partially within the downthrust chamber 202. The downthrust bearing 204 may be arranged or oriented to absorb axial forces directed downward, such as downstream in the wellbore 108, along the shaft 218. The downthrust runner 206, which may be keyed to the shaft 218, can transmit the axial forces to the downthrust bearing 204, for example to facilitate load management and to provide mechanical stability for the split protected thrust chamber system 200.

The seal guide 208 may be positioned between the downthrust chamber 202 and the upthrust chamber 212. The seal guide 208 can house the radial seal 210, which may offer radial support to the shaft 218, which can ensure that the shaft 218 remains centered and stable during operation of the split protected thrust chamber system 200. Additionally or alternatively, the mechanical seal 220 may be positioned within the seal guide 208 to form a barrier that helps prevent well fluid ingress or debris migration from the upthrust chamber 212 into the downthrust chamber 202, or vice versa, for example for protecting the downthrust bearing 204.

In some examples, the upthrust chamber 212 may include the upthrust bearing 214, the upthrust runner 216, other suitable components, or any combination thereof. The upthrust bearing 214 can absorb axial forces directed upward, or upstream, along the shaft 218, while the upthrust runner 216, which may also be keyed to the shaft 218, can transmit the axial forces to the upthrust bearing 214. The arrangement of the upthrust chamber 212 and the downthrust chamber 202, separated by the seal guide 208 and the mechanical seal 220, may allow for effective oil management and better heat dissipation when split protected thrust chamber system 200 is used in heat-intensive applications.

In some examples, the seal guide 208, which may be positioned between the downthrust chamber 202 and the upthrust chamber 212, can be constructed with features that facilitate alignment and stabilization of the shaft 218. For example, the seal guide 208 can include the radial seal 210, which may act to provide radial support to the shaft 218 for keeping the shaft 218 properly aligned within the split protected thrust chamber system 200 and for minimizing vibration or mechanical wear. The mechanical seal 220 may be or include a barrier to control flow of fluids and to prevent debris from migrating between the chambers. In some examples, the mechanical seal 220 may be or include a physical obstruction that can control fluid flow and prevent debris migration.

The shaft 218 may extend through the upthrust chamber 212 and the downthrust chamber 202, and in some examples past each of the chambers, for transferring mechanical energy along the split protected thrust chamber system 200. The shaft 218 may be stabilized and supported by the upthrust bearing 214, the downthrust bearing 204, the radial seal 210 within the seal guide 208, or any combination thereof to ensure efficient operation and to manage thrust loads in axial directions in the split protected thrust chamber system 200.

The downthrust chamber 202 may receive or otherwise accommodate the downthrust bearing 204 and the downthrust runner 206 in a manner that optimizes load distribution and enhances the durability of the split protected thrust chamber system 200. The downthrust bearing 204 may operate using oil to reduce friction and wear, such as in high-temperature environments, while the downthrust runner 206 may be engineered to interface precisely with the bearing surface. The configuration of the downthrust bearing 204 and the downthrust runner 206 can allow for effective thrust absorption in the downward or downstream direction for protecting the motor and other critical components downstream of the split protected thrust chamber system 200.

In some examples, the downthrust chamber 202 may define a first volume for receiving heat-dissipating fluid, such as machine oil, and the upthrust chamber 212 may define a second volume for receiving the heat-dissipating fluid. The first volume and the second volume may be axially offset along the shaft 218 and may be kept separate from each other by the seal guide 208 and the mechanical seal 220. The separation and axial offset of the first volume and the second volume may facilitate efficient heat dissipation around the downthrust bearing and the upthrust bearing for helping to manage the thermal conditions in high-temperature wellbore environments in which the split protected thrust chamber system 200 may be disposed.

The upthrust chamber 212 may include the upthrust bearing 214 and the upthrust runner 216. The upthrust bearing 214 and the upthrust runner 216 may work together to manage axial forces directed upward or upstream along the shaft 218. The upthrust runner 216 can be keyed to the shaft 218 and may be responsible for transmitting upward forces to the upthrust bearing 214 for ensuring effective load management.

The shaft 218, which can run continuously through the split protected thrust chamber system 200, may be a central component of the split protected thrust chamber system 200. In some examples, the shaft 218 can transfer rotational and axial forces within, or external to, the split protected thrust chamber system 200. The shaft 218 can be supported at multiple points. For example, the shaft 218 can be supported by the downthrust bearing 204, by the upthrust bearing 214, by the radial seal 210 within the seal guide 208, or by any combination thereof. The support structure formed by the above-described components may reduce deflection and wear of the shaft 218, which may enhance a longevity of the split protected thrust chamber system 200 or the ESP in which the split protected thrust chamber system 200 is disposed. The precise interaction between the shaft 218 and the other components of the split protected thrust chamber system 200 may maintain efficient operation and may minimize the risk of mechanical failure, even in harsh wellbore environments, of the split protected thrust chamber system 200.

Figure 3:
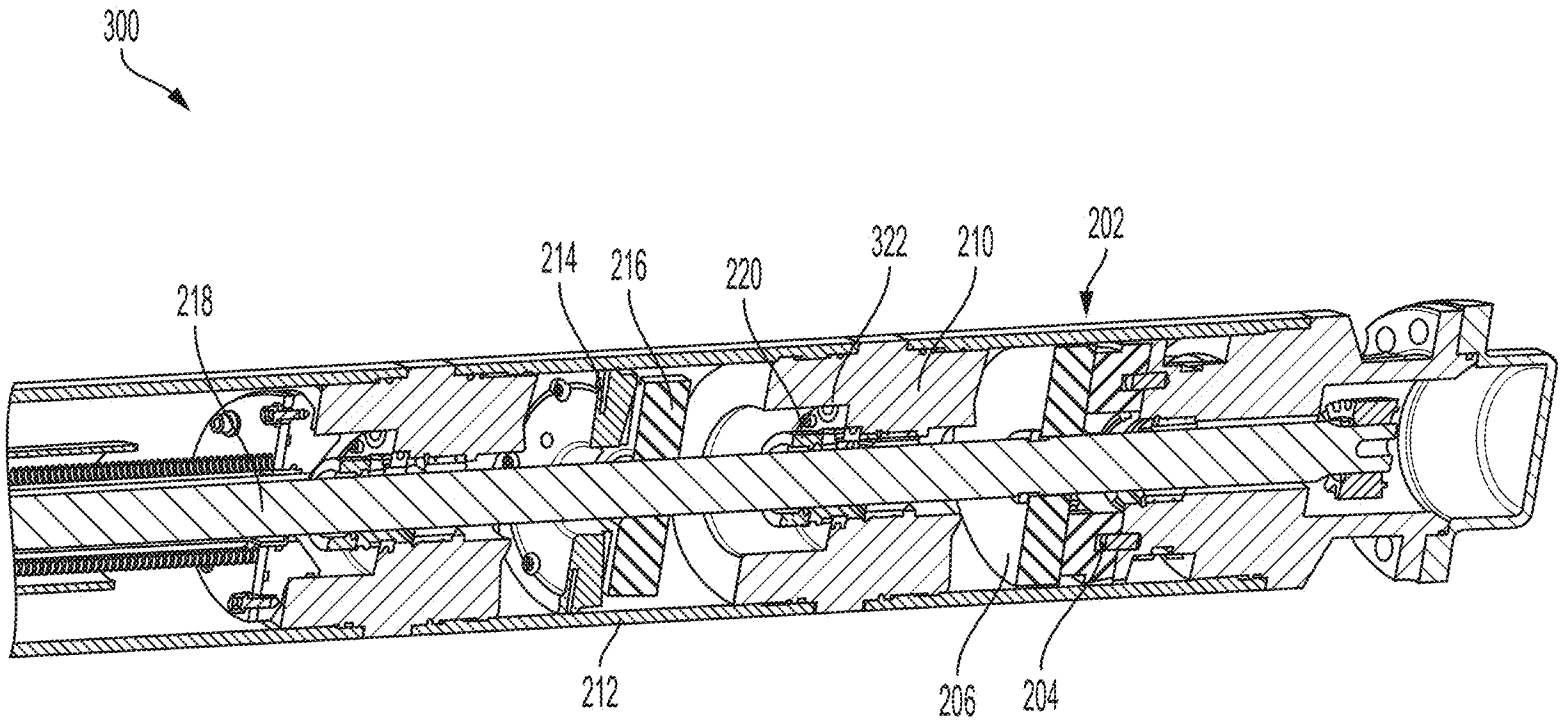
FIG. 3 is a cut-away view of a split protected thrust chamber with fluid transfer channel and mechanical seal according to some aspects of the present disclosure.

FIG. 3 is a sectional view of a split protected thrust chamber system 200 that may be used in an electrical submersible pump (ESP). The split protected thrust chamber system 200 may include the downthrust chamber 202, the downthrust bearing 204, the downthrust runner 206, the upthrust chamber 212, the upthrust bearing 214, the upthrust runner 216, a shaft 218, a mechanical seal 220, and a fluid transfer channel 322. The split protected thrust chamber system 200 may include any additional, alternative, or fewer components for providing functionality for the split protected thrust chamber system 200 or the ESP in which the split protected thrust chamber system 200 is disposed. The mechanical seal 220, such as via the seal guide 208, may be positioned between the upthrust chamber 212 and the downthrust chamber 202. The mechanical seal 220 can act as a barrier, such as a physical obstruction, to prevent well fluid ingress and debris from migrating between the downthrust chamber 202 and the upthrust chamber 212, for example for at least protecting the downthrust bearing 204 from potential contamination or other damage or undesirable effects.

The fluid transfer channel 322 may be integrated into the split protected thrust chamber system 200, such as via the seal guide 208, to provide a controlled path for oil or other suitable heat-dissipating fluid, to move between the upthrust chamber 212 and the downthrust chamber 202. The fluid transfer channel 322 may be a small opening, such as a cylindrical channel, that can be located in the seal guide 208 such as just above or offset from the mechanical seal 220. The fluid transfer channel 322 may be visible in sectional views of the split protected thrust chamber system 200 as a hole or opening near the mechanical seal 220. The oil flow regulation provided by the fluid transfer channel 322 may help ensure consistent lubrication and temperature control in the split protected thrust chamber system 200, while also keeping the flow controlled to prevent any rapid transfer that can disrupt performance of the split protected thrust chamber system 200.

In some examples, the fluid transfer channel 322 may further include a filter. The filter may be or include a mechanical filter, a chemical filter, or other suitable filter that can be positioned in the fluid transfer channel 322. In some examples, the filter may remove debris from the fluid flowing between the upthrust chamber 212 and the downthrust chamber 202. The filter may be integrated within the fluid transfer channel 322 to trap contaminants and to prevent the contaminants from migrating from one chamber to the other and for protecting the downthrust bearing 204 and the upthrust bearing 214 from potential damage.

Figure 4:
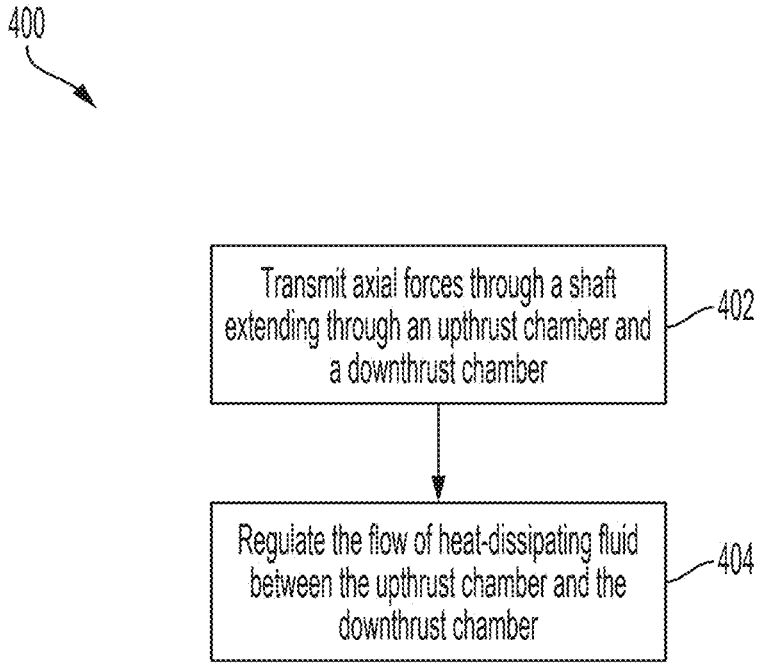
FIG. 4 is a flowchart of a process for operating a split protected thrust chamber in an electrical submersible pump according to some aspects of the present disclosure.

FIG. 4 is a flowchart of a process 400 for operating a split protected thrust chamber system 200 in an electrical submersible pump (ESP) according to some aspects of the present disclosure. At block 402, axial forces are transmitted through a shaft, such as the shaft 218, extending through an upthrust chamber, such as the upthrust chamber 212, and a downthrust chamber such as the downthrust chamber 202. An upthrust runner, such as the upthrust runner 216, which can be coupled with the shaft, can transmit upward axial forces to an upthrust bearing, such as the upthrust bearing 214, within the upthrust chamber. Additionally or alternatively, a downthrust runner, such as the downthrust runner 206, which can also be coupled with the shaft, can transmit downward axial forces to a downthrust bearing, such as the downthrust bearing 204, within the downthrust chamber. In some examples, the upthrust chamber may be axially offset from the downthrust chamber via a seal guide such as the seal guide 208. This arrangement may help manage axial loads effectively within the split protected thrust chamber system 200.

At block 404, flow of heat-dissipating fluid, such as oil, between the upthrust chamber and the downthrust chamber is regulated. In some examples, the flow can be controlled via a communication port, such as the fluid transfer channel 322, in the seal guide that can be positioned between the upthrust chamber and the downthrust chamber. The communication port may include a filter that can be used to remove debris from the flow of heat-dissipating fluid. The filter can protect the bearings and can ensure reliable operation of the split protected thrust chamber system 200. The regulation of heat-dissipating fluid flow may aid in maintaining proper lubrication and heat dissipation, which can provide for efficient performance by the split protected thrust chamber system 200 in high-temperature wellbore environments, with respect to the split protected thrust chamber system 200.

In some aspects, systems and methods for a split protected thrust chamber system are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a first thrust chamber comprising a first bearing for absorbing thrust in a first direction in a wellbore; a second thrust chamber comprising a second bearing for absorbing thrust in a second direction in the wellbore that is different than the first direction; and a seal guide positionable between the first thrust chamber and the second thrust chamber to separate the first thrust chamber from the second thrust chamber, the seal guide for protecting the second thrust chamber and for providing radial support for a shaft positionable in the first thrust chamber and the second thrust chamber.

Example 2 is the system of example 1, further comprising the shaft, wherein: the first thrust chamber further comprises a first runner couplable with the shaft at a first location along the shaft; the second thrust chamber further comprises a second runner couplable with the shaft at a second location along the shaft; and the shaft extends through the first thrust chamber, the second thrust chamber, and the seal guide.

Example 3 is the system of example 2, wherein the seal guide comprises a mechanical seal positionable around the shaft at a third location between the first location and the second location, and wherein flow of oil and debris is restrictable between the first thrust chamber and the second thrust chamber.

Example 4 is the system of example 1, wherein the first thrust chamber defines a first volume for receiving heat-dissipating fluid, wherein the second thrust chamber defines a second volume for receiving the heat-dissipating fluid, and wherein the first volume is axially offset along the shaft and separate from the second volume.

Example 5 is the system of example 4, wherein the seal guide defines a third volume of empty space that is positionable between the first volume and the second volume, wherein the heat-dissipating fluid is selectively transferrable from the first volume to the second volume, or vice versa, via the third volume.

Example 6 is the system of example 1, wherein the seal guide comprises a fluid transfer channel that fluidically couples the first thrust chamber with the second thrust chamber, and wherein the fluid transfer channel comprises a filter for filtering debris out of fluid flowing from the first thrust chamber to the second thrust chamber or vice versa.

Example 7 is the system of example 1, wherein the first bearing is a down-thrust bearing, wherein the second bearing is an up-thrust bearing, wherein the first direction extends downstream of the first thrust chamber, and wherein the second direction extends upstream of the second thrust chamber.

Example 8 is a system comprising: a shaft positionable in a wellbore; a first thrust chamber positionable around the shaft and comprising a first bearing for absorbing thrust in a first direction in the wellbore; a second thrust chamber positionable around the shaft and comprising a second bearing for absorbing thrust in a second direction in the wellbore that is different than the first direction; and a seal guide positionable between the first thrust chamber and the second thrust chamber to separate the first thrust chamber from the second thrust chamber, the seal guide for protecting the second thrust chamber and for providing radial support for the shaft.

Example 9 is the system of example 8, wherein: the first thrust chamber further comprises a first runner couplable with the shaft at a first location along the shaft; the second thrust chamber further comprises a second runner couplable with the shaft at a second location along the shaft; and the shaft extends through the first thrust chamber, the second thrust chamber, and the seal guide.

Example 10 is the system of example 9, wherein the seal guide comprises a mechanical seal positionable around the shaft at a third location between the first location and the second location, and wherein flow of oil and debris is restrictable between the first thrust chamber and the second thrust chamber.

Example 11 is the system of example 8, wherein the first thrust chamber defines a first volume for receiving heat-dissipating fluid, wherein the second thrust chamber defines a second volume for receiving the heat-dissipating fluid, and wherein the first volume is axially offset along the shaft and separate from the second volume.

Example 12 is the system of example 11, wherein the seal guide defines a third volume of empty space that is positionable between the first volume and the second volume, wherein the heat-dissipating fluid is selectively transferrable from the first volume to the second volume, or vice versa, via the third volume.

Example 13 is the system of example 8, wherein the seal guide comprises a fluid transfer channel that fluidically couples the first thrust chamber with the second thrust chamber, and wherein the fluid transfer channel comprises a filter for filtering debris out of fluid flowing from the first thrust chamber to the second thrust chamber or vice versa.

Example 14 is the system of example 8, wherein the first bearing is a down-thrust bearing, wherein the second bearing is an up-thrust bearing, wherein the first direction extends downstream of the first thrust chamber, and wherein the second direction extends upstream of the second thrust chamber.

Example 15 is a downhole pump comprising: a first thrust chamber comprising a first bearing for absorbing thrust in a first direction in a wellbore; a second thrust chamber comprising a second bearing for absorbing thrust in a second direction in the wellbore that is different than the first direction; and a seal guide positionable between the first thrust chamber and the second thrust chamber, the seal guide comprising an obstruction positionable around a shaft to separate the first thrust chamber from the second thrust chamber, and the seal guide for protecting the second thrust chamber and for providing radial support for the shaft that is positionable in the first thrust chamber and the second thrust chamber.

Example 16 is the downhole pump of example 15, further comprising the shaft, wherein: the first thrust chamber further comprises a first runner couplable with the shaft at a first location along the shaft; the second thrust chamber further comprises a second runner couplable with the shaft at a second location along the shaft; and the shaft extends through the first thrust chamber, the second thrust chamber, and the seal guide.

Example 17 is the downhole pump of example 16, wherein the seal guide comprises a mechanical seal positionable around the shaft at a third location between the first location and the second location, and wherein flow of oil and debris is restrictable between the first thrust chamber and the second thrust chamber.

Example 18 is the downhole pump of example 15, wherein the first thrust chamber defines a first volume for receiving heat-dissipating fluid, wherein the second thrust chamber defines a second volume for receiving the heat-dissipating fluid, and wherein the first volume is axially offset along the shaft and separate from the second volume.

Example 19 is the downhole pump of example 18, wherein the seal guide defines a third volume of empty space that is positionable between the first volume and the second volume, wherein the heat-dissipating fluid is selectively transferrable from the first volume to the second volume, or vice versa, via the third volume.

Example 20 is the downhole pump of example 15, wherein the seal guide comprises a fluid transfer channel that fluidically couples the first thrust chamber with the second thrust chamber, and wherein the fluid transfer channel comprises a filter for filtering debris out of fluid flowing from the first thrust chamber to the second thrust chamber or vice versa.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a first section of a thrust chamber comprising a first bearing for absorbing thrust in a first direction in a wellbore;

a second section of the thrust chamber comprising a second bearing for absorbing thrust in a second direction in the wellbore that is different than the first direction; and a seal guide positionable between the first section and the second section to separate the first section from the second section, the seal guide for protecting the second section and for providing radial support for a shaft positionable in the thrust chamber, the first section spaced apart from the seal guide in the first direction along an axis to define a first volume sized to receive heat-dissipating fluid, the second section spaced apart from the seal guide in the second direction along the axis to define a second volume sized to receive the heat-dissipating fluid, the first volume extending from the shaft to an inner diameter of the first section and extending from the first bearing to the seal guide, and the second volume extending from the shaft to an inner diameter of the second section and extending from the second bearing to the seal guide.

2. The system of claim 1, further comprising the shaft, wherein:

the first section of the thrust chamber further comprises a first runner couplable with the shaft at a first location along the shaft;

the second section of the thrust chamber further comprises a second runner couplable with the shaft at a second location along the shaft; and the shaft extends through the first section of the thrust chamber, the second section of the thrust chamber, and the seal guide.

3. The system of claim 2, wherein the seal guide comprises a mechanical seal positionable around the shaft at a third location between the first location and the second location, and wherein flow of oil and debris is restrictable between the first section of the thrust chamber and the second section of the thrust chamber.

4. The system of claim 1, wherein the first volume is axially offset along the shaft and separate from the second volume.

5. The system of claim 4, wherein the seal guide defines a third volume of empty space that is positionable between the first volume and the second volume, wherein the heat-dissipating fluid is transferrable from the first volume to the second volume, or vice versa, via the third volume.

6. The system of claim 1, wherein the seal guide comprises a fluid transfer channel that fluidically couples the first section of the thrust chamber with the second section of the thrust chamber, and wherein the fluid transfer channel comprises a filter for filtering debris out of fluid flowing from the first section of the thrust chamber to the second section of the thrust chamber or vice versa.

7. The system of claim 1, wherein the first bearing is a down-thrust bearing, wherein the second bearing is an up-thrust bearing, wherein the first direction extends downstream of the first section of the thrust chamber, and wherein the second direction extends upstream of the second section of the thrust chamber.

8. A system comprising:

a shaft positionable in a wellbore;

a first section of a thrust chamber positionable around the shaft and comprising a first bearing for absorbing thrust in a first direction in the wellbore;

a second section of the thrust chamber positionable around the shaft and comprising a second bearing for absorbing thrust in a second direction in the wellbore that is different than the first direction; and a seal guide positionable between the first section of the thrust chamber and the second section of the thrust chamber to separate the first section of the thrust chamber from the second section of the thrust chamber, the seal guide for protecting the second section of the thrust chamber and for providing radial support for the shaft, the first section of the thrust chamber spaced apart from the seal guide in the first direction along an axis to define a first volume sized to receive heat-dissipating fluid, the second section of the thrust chamber spaced apart from the seal guide in the second direction along the axis to define a second volume sized to receive the heat-dissipating fluid, the first volume extending from the shaft to an inner diameter of the first section and extending from the first bearing to the seal guide, and the second volume extending from the shaft to an inner diameter of the second section and extending from the second bearing to the seal guide.

9. The system of claim 8, wherein:

the first section of the thrust chamber further comprises a first runner couplable with the shaft at a first location along the shaft;

the second section of the thrust chamber further comprises a second runner couplable with the shaft at a second location along the shaft; and the shaft extends through the first section of the thrust chamber, the second section of the thrust chamber, and the seal guide.

10. The system of claim 9, wherein the seal guide comprises a mechanical seal positionable around the shaft at a third location between the first location and the second location, and wherein flow of oil and debris is restrictable between the first section of the thrust chamber and the second section of the thrust chamber.

11. The system of claim 8, wherein the first volume is axially offset along the shaft and separate from the second volume.

12. The system of claim 11, wherein the seal guide defines a third volume of empty space that is positionable between the first volume and the second volume, wherein the heat-dissipating fluid is transferrable from the first volume to the second volume, or vice versa, via the third volume.

13. The system of claim 8, wherein the seal guide comprises a fluid transfer channel that fluidically couples the first section of the thrust chamber with the second section of the thrust chamber, and wherein the fluid transfer channel comprises a filter for filtering debris out of fluid flowing from the first section of the thrust chamber to the second section of the thrust chamber or vice versa.

14. The system of claim 8, wherein the first bearing is a down-thrust bearing, wherein the second bearing is an up-thrust bearing, wherein the first direction extends downstream of the first section of the thrust chamber, and wherein the second direction extends upstream of the second section of the thrust chamber.

15. A downhole pump comprising:

a first section of a thrust chamber comprising a first bearing for absorbing thrust in a first direction in a wellbore;

a second section of the thrust chamber comprising a second bearing for absorbing thrust in a second direction in the wellbore that is different than the first direction; and a seal guide positionable between the first section of the thrust chamber and the second section of the thrust chamber, the seal guide comprising an obstruction positionable around a shaft to separate the first section of the thrust chamber from the second section of the thrust chamber, the seal guide for protecting the second section of the thrust chamber and for providing radial support for the shaft that is positionable in the first section of the thrust chamber and the second section of the thrust chamber, the first section of the thrust chamber spaced apart from the seal guide in the first direction along an axis to define a first volume sized to receive heat-dissipating fluid, the second section of the thrust chamber spaced apart from the seal guide in the second direction along the axis to define a second volume sized to receive the heat-dissipating fluid, the first volume extending from the shaft to an inner diameter of the first section and extending from the first bearing to the seal guide, and the second volume extending from the shaft to an inner diameter of the second section and extending from the second bearing to the seal guide.

16. The downhole pump of claim 15, further comprising the shaft, wherein:

the first section of the thrust chamber further comprises a first runner couplable with the shaft at a first location along the shaft;

the second section of the thrust chamber further comprises a second runner couplable with the shaft at a second location along the shaft; and the shaft extends through the first section of the thrust chamber, the second section of the thrust chamber, and the seal guide.

17. The downhole pump of claim 16, wherein the seal guide comprises a mechanical seal positionable around the shaft at a third location between the first location and the second location, and wherein flow of oil and debris is restrictable between the first section of the thrust chamber and the second section of the thrust chamber.

18. The downhole pump of claim 15, wherein the first volume is axially offset along the shaft and separate from the second volume.

19. The downhole pump of claim 18, wherein the seal guide defines a third volume of empty space that is positionable between the first volume and the second volume, wherein the heat-dissipating fluid is transferrable from the first volume to the second volume, or vice versa, via the third volume.

20. The downhole pump of claim 15, wherein the seal guide comprises a fluid transfer channel that fluidically couples the first section of the thrust chamber with the second section of the thrust chamber, and wherein the fluid transfer channel comprises a filter for filtering debris out of fluid flowing from the first section of the thrust chamber to the second section of the thrust chamber or vice versa.

* * * * *